United States Patent [19]

Langenhorst

[11] 4,274,235

[45] Jun. 23, 1981

[54] WINDOW-FRAME ASSEMBLY

[75] Inventor: Günter Langenhorst, Bad Sassendorf, Fed. Rep. of Germany

[73] Assignee: top-element Bauelemente für Irnenausbau & Raumgestaltung GmbH & Co. KG, Hamm, Fed. Rep. of Germany

[21] Appl. No.: 110,365

[22] Filed: Jan. 8, 1980

[30] Foreign Application Priority Data

Jan. 10, 1979 [DE] Fed. Rep. of Germany ..... 2900693

[51] Int. Cl.[3] ..... E06B 1/04

[52] U.S. Cl. ..... 52/213; 52/656

[58] Field of Search ..... 52/213, 656, 214, 204

[56] References Cited

U.S. PATENT DOCUMENTS

| | | | |
|---|---|---|---|
| 3,866,380 | 2/1975 | Benson | 52/656 |
| 3,930,738 | 1/1976 | Thuss et al. | 52/204 X |
| 3,956,855 | 5/1976 | Walker | 52/656 X |
| 4,143,493 | 3/1979 | Booi | 52/656 X |

FOREIGN PATENT DOCUMENTS

| | | | |
|---|---|---|---|
| 963169 | 7/1964 | United Kingdom | 52/214 |
| 1499116 | 1/1978 | United Kingdom | 52/214 |

*Primary Examiner*—Carl D. Friedman
*Attorney, Agent, or Firm*—Karl F. Ross

[57] ABSTRACT

A frame assembly for mounting between a pair of generally parallel members has four elongated frame elements each having two ends each having a longitudinally outwardly open recess. These elements are arrayed in a rectangle with two of the elements parallel to each other and lying against the members and the other two of the elements being parallel to each other and extending generally perpendicular to the members and forming corners with the other elements. Respective Y-shaped corner pieces are provided at the corners and each have a pair of generally perpendicular arms received in the respective recesses and a central leg. One of these arms of each piece is elastically deflectable toward and away from the other arm of the respective piece. The central legs are nailed or screwed to the members to displace the Y-shaped pieces between positions with the legs spaced from the members and into positions with these legs closely juxtaposed with the members so as simultaneously elastically to urge one of the elements at the respective corner against the other element at the respective corner.

10 Claims, 4 Drawing Figures

WINDOW-FRAME ASSEMBLY

FIELD OF THE INVENTION

The present invention relates to a frame assembly. More particularly this invention concerns such an assembly usable for mounting a window or the like between a pair of frame members, such as a pair of studs.

BACKGROUND OF THE INVENTION

In construction the standard practice when a window or similar element such as a skylight or door is to be mounted between members such as beams, studs, or rafter, is simply to mount a fully prefabricated frame assembly between these members, and to secure it in place by nailing through tabs provided for this purpose. The frame is normally constituted as an annular array of frame elements joined at corners and provided in several standard sizes, as for example a size adapted to fit between a pair of standard studs on 16-inch centers.

A considerable disadvantage of this type of construction is that these frame assemblies must be rather painstakingly packaged and cared for prior to installation. They are relatively bulky so that shipping and storage costs are a problem. What is more it is necessary that the structure in which they are mounted be of predetermined dimensions, as if the opening in which they are to be inserted is off size, filler strips and the like become necessary

OBJECTS OF THE INVENTION

It is therefore the object of the present invention to provide an improved frame assembly.

Another object of this invention is to provide such an assembly which takes up minimal space during storage and shipping.

Yet another object is to provide such an assembly which can be readily adapted to different sizes.

SUMMARY OF THE INVENTION

These objects are attained according to the instant invention in an arrangement of the above-described general type wherein frame elements are joined together in corners by devices each constituted as a Y-shaped clip or corner piece having a pair of elastically deformable arms which engage over the frame elements in the corners, as well as a central leg which is displaced from a position spaced from the wall into a position engaged against the wall so as to elastically urge the ends of the respective frame elements against each other at the respective corners. The system according to the instant invention therefore allows the frame to be shipped and stored in knocked-down condition, yet the frame can readily be assembled on the job by even a relatively inexperienced carpenter. As a result of the elasticity of the arms of the corner pieces the frame elements themselves are held tightly in place and urged elastically tightly into engagement with each other so that the frame thus formed is extremely rigid. As the corner pieces are screwed or nailed to the respective members the frame is tightened so that subsequent shifting of its parts is impossible. In fact it is possible to use a plurality of such corner pieces at each corner, when the frame members are wide measured perpendicular to the plane of the frame.

According to further features of this invention the arms fit with considerable play within the respective recesses, which themselves are in fact formed by constituting a frame element as hollow metal profiles. In fact the frame elements can be constituted as channels having inwardly directed lips which form the respective recesses. A filler strip formed like the corner pieces of aluminum and of generally U-section is engaged in the crotch of each of the corner pieces. This filler strip is substantially softer than the corner pieces and is formed with a groove receiving and edge of one of the ends of one of the respective frame elements, so that this strip ensures excellent connection between the two parts with a good seal at the corner. Each such strip has a pair of U-shaped lips that engage over the respective arms of the respective corner piece. These U-shaped lips fill the respective recesses from side to side to form a tight fit and good seal between the various parts of the instant invention.

According to this invention one of the arms of each of the corner pieces is made substantially lighter than the other arms so as to be substantially more elastically deformable than the other arm. This other arm in turn is constituted with an end formed as a rod over which the strip is engaged. In addition this other arm is formed with a bump constituting a pivot or fulcrum on the respective member for pivoting of the corner piece between the outer and inner positions as it is tightened in place during installation of the frame assembly.

SPECIFIC DESCRIPTION

Figure 1:
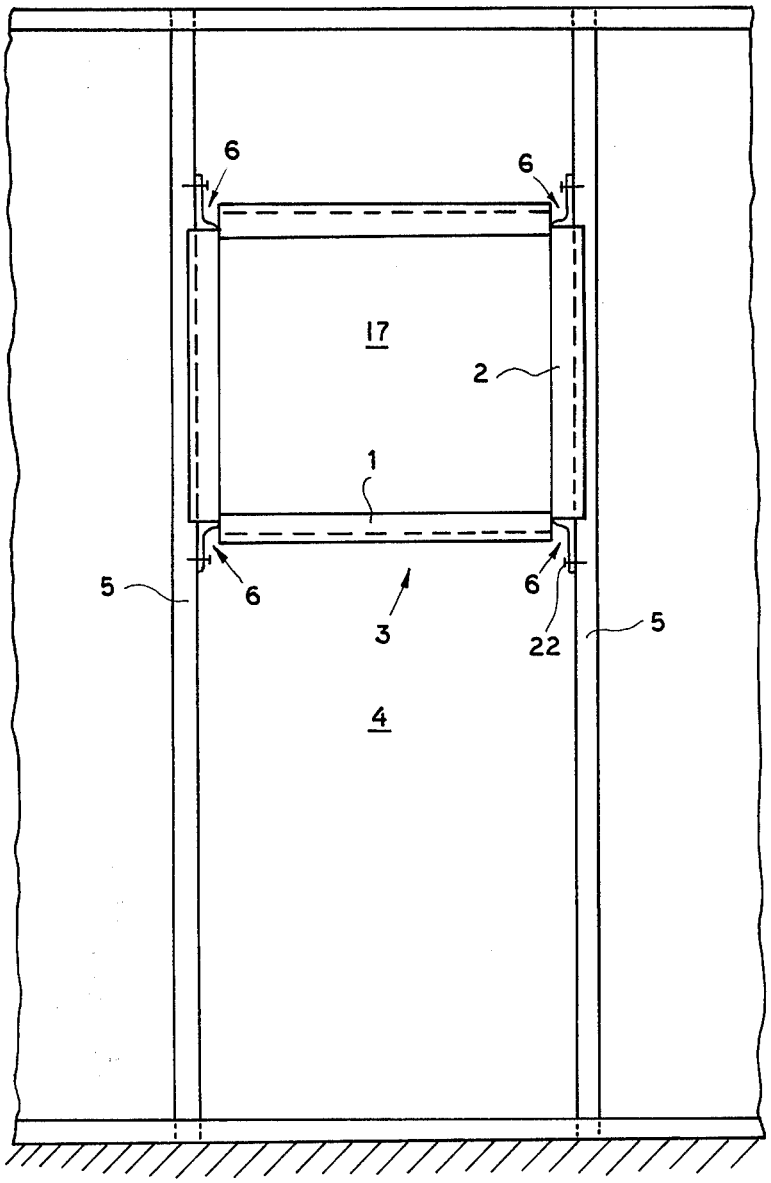
FIG. 1 is a front elevational view of the frame assembly according to the instant invention.
Figure 2:
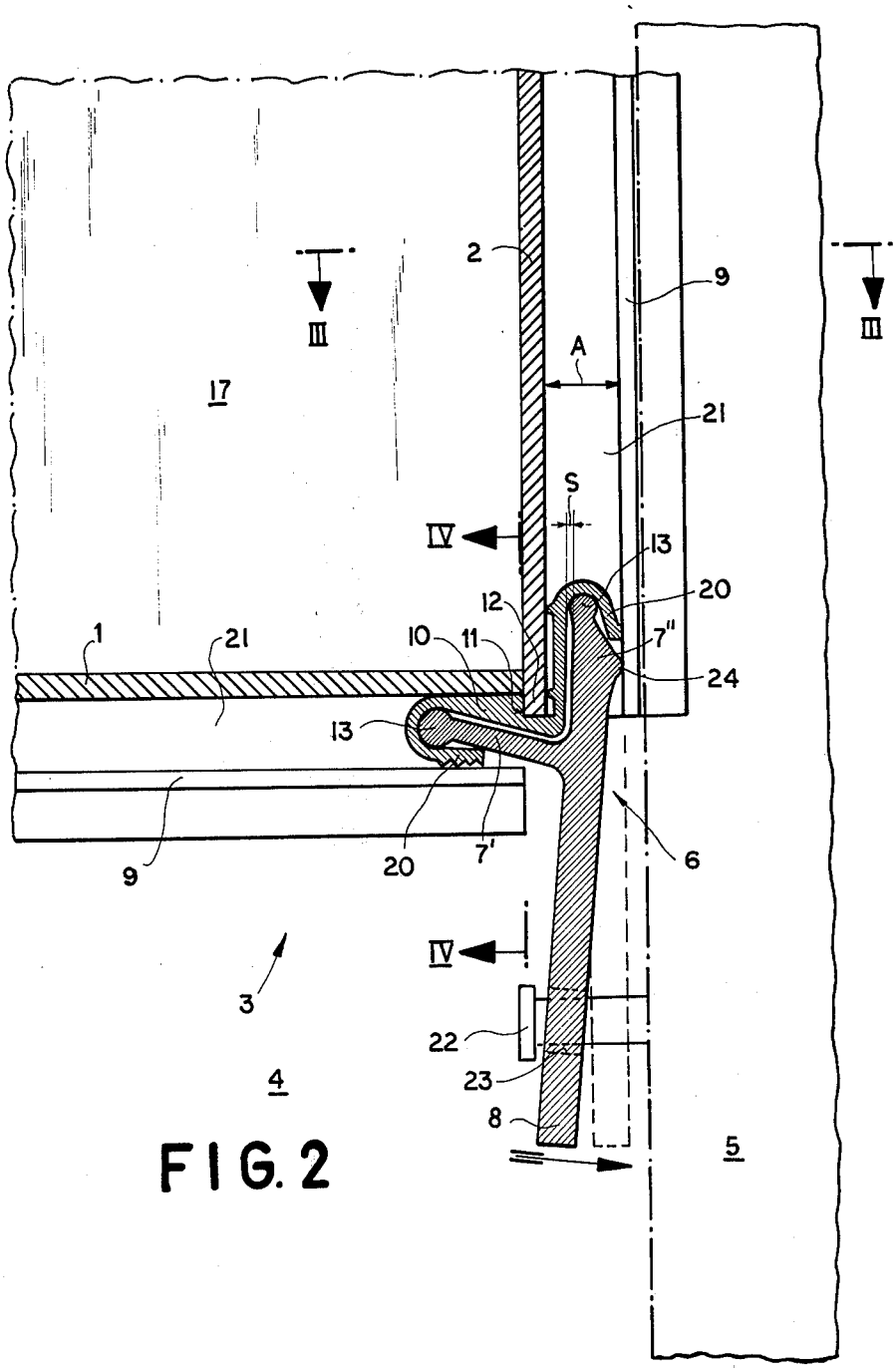
FIG. 2 is a large-scale sectional view of a detail of FIG. 1.
Figure 4:
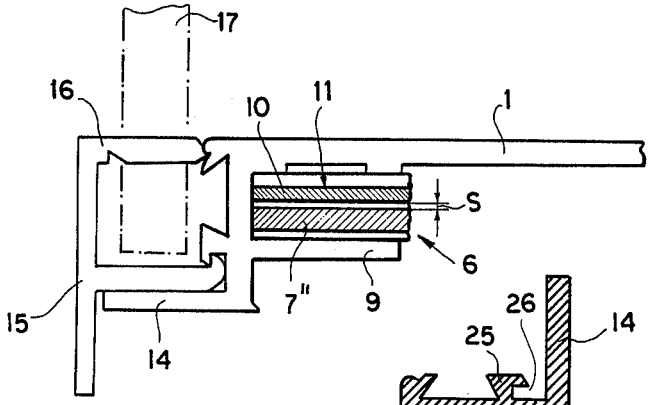
FIGS. 3 and 4 are sections taken respectively along lines III—III and IV—IV of FIG. 2.

As shown in FIG. 1 a frame assembly basically has a pair of horizontal frame elements 1 and a pair of identical vertical frame elements 2, together forming a frame 3 in a bay 4 between a pair of vertical studs 5. The frame elements 1 and 2 are joined together by means of corner elements 6 shown in more detail in FIGS. 2–4. Each of these elements 6 is generally Y-shaped, having a pair of of arms 7′ and 7″ and a leg 8. The elements 1 and 2 are formed as identical channels of aluminum or a synthetic resin, and have lips 9 forming recesses 21. The arms 7′ and 7″ are engaged in the recesses 21 of the respective elements 1 and 2 and a nail 22 is driven through a hole 23 adjacent the outer end of the leg 8, so as to move the piece 6 between a solid-line position and the dashed-line position of FIG. 2. This action tightens the respective element 2 against the member 5, while pulling down the respective element 1 and ensuring that the two elements 1 and 2 are engaged tightly against each other with some elastic deformation of the arm 7′.

An aluminum seal strip 10 formed with a central groove or shoulder 11 is received in the crotch between the arms 7′ and 7″ of each of the corner pieces, with the edge 12 of the one element 2 received in groove 11. The outer end of each of the arms 7′ and 7″ is formed as a rounded portion or rod 13 over which engages a U-section lip 20 of the strip 10. The strip 10 is substantially less elastic and more malleable than the corner piece 6 so that it fits snugly in the recesses 21. The height A of these recesses 21 is substantially greater than the combined width of the arms 7″ and the thickness of the strip 10 by a play S so that the entire arrangement can deform somewhat in the recess 21 of the element 2. In addition the one arm 7'' is substantially thicker than the arm 7' and is formed with a bump 24 that acts as a pivot or fulcrum for displacement of the corner piece 6 between the indicated positions, with engagement of the bump or pivot 24 on the lips 9 forming the back wall of the recess 21 of the element 2.

Figure 3:
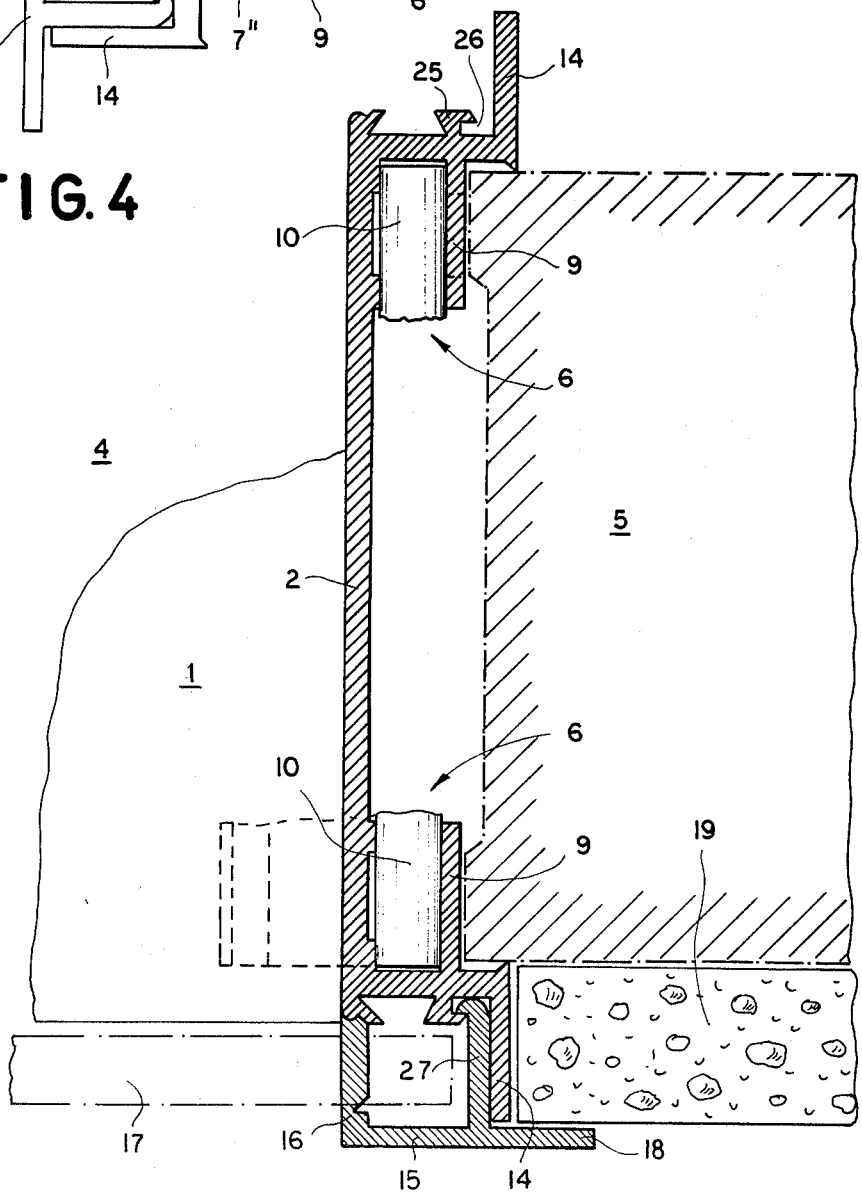

As best seen in FIG. 3 the element 2, which is identical in section to the element 1, has a central web which is slightly longer than the width of the respective stud 5, and which is formed adjacent each of the inwardly directed lips 9 with an outwardly directed lip 14 forming with a ridge 25 a recess 26 in which is engageable a tab 27 of a covering member 15 formed with a weakened zone 16 so that a pane 17 of glass or the like can be mounted between the elements 15 and 2. In addition an outwardly extending decorative lip 18 on the profile member 15 engages over wall-finishing materials such as plasterboard 19. Thus the system according to the instant invention allows the window opening to be finished without the use of joint compound, as the flaps 18 will simply cover any poor fit between the plasterboard 19 and the lip 14. If the opening formed by the frame 3 is not to be glazed or filled, the profile members 15 merely form an even continuation of the members 1 and 2, preferably being mitered at the corners.

Thus the assembly according to the instant invention can be put together easily and rapidly directly on the job site by even a relatively unskilled carpenter. The members 1 and 2 can be cut on the job from a long strip of aluminum stock material. Indeed the frame assembly can be custom-fitted to virtually any size opening. It can be used for installing a window, small doorway, skylight or virtually any other such structure which needs a rigid frame mounted directly to structural members.

I claim:

1. A frame assembly for mounting between a pair of generally parallel members, said assembly comprising:

four elongated frame elements each having two ends such having a longitudinally outwardly open recess, said elements being arrayed in a rectangle with two of said elements parallel to each other and lying against said members and the other two of said elements being parallel to each other and extending generally perpendicular to said members, said elements meeting at corners at said members;

respective Y-shaped corner pieces at said corners each having a pair of generally perpendicular arms received in the respective recesses and a central leg, one of said arms of each piece being elastically deflectable toward and away from the other arm of the respective piece; and means for displacing said central legs from positions spaced from into positions closely juxtaposed with the respective members and for simultaneously elastically urging one of the members at the respective corner with the respective arm against the other member at the respective corner.

2. The assembly defined in claim 1 wherein said elements are metal profiles of regular cross section.

3. The assembly defined in claim 2 wherein said arms are received with play in the respective recesses.

4. The assembly defined in claim 3, further comprising respective generally U-section strips lying in the crotches between said arms and each having a pair of lips overlapping the ends of the respective arms.

5. The assembly defined in claim 4 wherein said strips are each formed with a groove receiving the end of one of the respective elements.

6. The assembly defined in claim 4 wherein each of said strips is generally U-shaped and overreaches the respective arm at each of said lips.

7. The assembly defined in claim 6 wherein each of said other arms is formed as a rod perpendicular to the respective element, said rod being overreached by the respective U-shaped lip.

8. The assembly defined in claim 7 wherein each of said other arms has an outwardly projecting bump engaging the respective member directly and acting as a pivot and fulcrum when the respective piece is displaced between said positions.

9. The assembly defined in claim 7 wherein said pieces and strips are formed of aluminum.

10. The assembly defined in claim 1 wherein said arms of each piece lie at an acute angle to each other in unstressed condition.

* * * * *